United States Patent [19]

Inger

[11] Patent Number: 4,845,933

[45] Date of Patent: Jul. 11, 1989

[54] DEVICE FOR SWITCHING OFF AND SWITCHING ON AGAIN A SPINNING OR TWISTING SPINDLE, MORE ESPECIALLY A TWO-FOR-ONE SPINNING OR TWISTING SPINDLE

[75] Inventor: Siegfried Inger, Krefeld, Fed. Rep. of Germany

[73] Assignee: Palitex Project Company GmbH, Krefeld, Fed. Rep. of Germany

[21] Appl. No.: 209,868

[22] Filed: Jun. 22, 1988

[30] Foreign Application Priority Data

Jun. 29, 1987 [DE] Fed. Rep. of Germany ..... 3721363

[51] Int. Cl.[4] ..... D01H 13/16; D01H 1/10

[52] U.S. Cl. ..... 57/80; 57/81; 57/58.83

[58] Field of Search ..... 57/78–83, 57/88, 89, 58.49, 58.83, 58.86

[56] References Cited

U.S. PATENT DOCUMENTS 4,280,322 7/1981 Inger ..... 57/81

*Primary Examiner*—John Petrakes

*Attorney, Agent, or Firm*—Bell, Seltzer, Park & Gibson

[57] ABSTRACT

A device for switching off and switching on the operation of a spindle of a textile twisting or spinning machine having a rumming thread is provided which includes the following elements. A pneumatic switching device is adapted to be operatively connected to a spindle stop mechanism of the textile machine for actuation and de-actuation thereof. A movable running thread sensor device is held in a first normal operating position by the running thread in the textile machine and moves to a second switching position upon breakage of the running thread. A movable breaking sensor device is adapted to be operatively connected to a spindle breaking mechanism of the textile machine for moving between a first position during normal operation of the spindle to a second position upon actuation of the spindle breaking mechanism after thread breakage. Pneumatic control mechanisms are operatively connected to the pneumatic switching device, the running thread sensor device and the movable breaking sensor device for operating the switching device to actuate the spindle stop mechanism upon breaking of the running thread to stop the spindle operation and the de-actuating the spindle stop mechanism upon actuation of the spindle breaking mechanism and before the running thread sensor device has returned to its normal operating position by the running thread during subsequent start-up of the spindle operation.

8 Claims, 4 Drawing Sheets

DEVICE FOR SWITCHING OFF AND SWITCHING ON AGAIN A SPINNING OR TWISTING SPINDLE, MORE ESPECIALLY A TWO-FOR-ONE SPINNING OR TWISTING SPINDLE

FIELD OF THE INVENTION

The device relates to a device for switching off and switching on again a spinning or twisting spindle, more especially a two-for-one spinning or twisting spindle.

BACKGROUND OF THE INVENTION

Such a device is known and described, for example, in DE-PS No. 29 25 027 corresponding to U.S. Pat. No. 4,280,322.

Such devices are used, for example, in the case of two-for-one twisting spindles in which the thread sensor is formed by the thread guide eyelet which limits the upper end of the thread balloon and which, with the thread running, is held by this in its operating position and is fastened to a holder which can be swivelled in the vertical direction. As a result of the centrifugal and air resistance force acting on the thread in the case of two-for-one twisting spindles, the thread is given a tensile force in the balloon region. Accordingly, thread forces are active at the balloon which can be utilised for switching functions. Upon a thread breakage the thread sensor moves out of the operating position into a switching position in which the switching member is actuated, whereby various procedures, e.g. registration, switching off and the like are triggered at the working location. Then by hand or by a servicing device the switching element can be moved out of its rest position into a braking position in which it exerts a control function in such a way that under specific conditions a restarting of the spindle is prevented. Now the necessary maintenance procedures can be carried out. After restoration of the switching element, the spindle is to start up again. So that, through the thread sensor which is still in the switching position, on account of balloon force which is not yet fully developed in the start-up phase, the monitoring mechanism is not immediately switched on again and thus the switch-off procedure is triggered afresh, in the case of the known device upon the restoring of the switching element a delay member becomes effective, which bridges or respectively prevents the function, triggering a stoppage of the spindle, of the thread sensor until the full thread force is built up and the thread sensor is disposed in the operating position.

The known device has the disadvantage that the pneumatic control mechanism of the monitoring mechanism is constructed in a relatively complex manner with two control valves between which a compressed-air store is connected, in which respect one of the two control valves is connected mechanically to the switching element. In this respect at least one of the two control valves has to be arranged in each case in the vicinity of the switching element, so that a direct mechanical coupling is not possible without excessively great expenditure. This has the result that the control valves in the case of machines having several twisting spindles are distributed over wide regions of the machine and cannot be combined and be arranged at constructionally particularly favourable locations.

OBJECT AND SUMMARY OF THE INVENTION

The problem underlying the invention consisted in designing a device for switching off and switching on the opeation of a spindle of a textile twisting or spinning machine having a running thread, in such a way that all the supervising members on the thread sensor and on the switching element can be arranged spatially separated from the control members of the pneumatic control mechanism, so that the latter can be arranged without mechanical coupling with thread sensor and/or switching element at favourable locations of the machine and can be combined in blockwise manner for example for an entire machine. The device should be constructed with slight expenditure and ensure high flexibility in use.

The solution to this problem takes place in accordance with the invention with the features of a device having the following elements. A pneumatic switching means is adapted to be operatively connected to a spindle stop mechanism of the textile machine for actuation and de-actuation thereof. Movable running threads sensor means are held in a first normal operating position by the running thread in the textile machine and are moved to a second switching position upon breakage of the running thread. Movable breaking sensor means are adapted to be operatively connected to a spindle breaking mechanism of the textile machine for moving between a first position during normal operation of the spindle to a second position upon actuation of the spindle breaking mechanism after thread breakage. Pneumatic control means are operatively connected to the pneumatic switching means, the running thread sensor means and the movable breaking sensor means for operating the switching means to actuate the spindle stop mechanism upon breaking of the running thread to stop the spindle operation and for deactuating the spindle stop mechanism upon actuation of the spindle breaking mechanism and before the running thread sensor means has returned to its normal operating position by the running thread during subsequent start-up of the spindle operation.

Preferably, the pneumatic control means comprises the following elements. A compressed air source means is provided. A first compressed air line means connects the compressed air source means to the pneumatic switching means. A first control valve means is positioned in the first compressed air line means for blocking the flow of compressed air to the switching means from the source in a first position thereof to de-actuate the spindle stop mechanism during normal operating conditions of the spindle and for opening the flow of compressed air to the switching means from the source in a second position thereof to operate the switching means to actuate the spindle stop mechanism upon breakage of the running thread. Second compressed air line means extends between the thread sensor means, the compressed air source means and the first control valve means for maintaining the first control valve means in its first air blocking position under normal air pressure therein. Second control valve means is positioned in the second compressed air line means for opening the flow of compressed air in the second compressed air line means in a first position thereof during normal operation of the spindle and for throttling the flow of compressed air in the second compressed air line means in a second position thereof. First venting means is positioned in the second compressed air line means for being closed when the running thread sensor means is held in the first normal operating position thereof and for being opened upon thread breakage and the thread sensor means moving to its second switching position for venting air pressure in the second compressed air line means to effect movement of the first control valve means to open the flow of compressed air to the pneumatic switching means to operate the spindle stop mechanism. Third compressed air line means extend between the second compressed air line means, the movable break sensor means and the second control valve means. Second venting means are positioned in the third compressed air line means for being closed when said breaking sensor means is in the first position thereof and for being opened upon actuation of the spindle breaking mechanism and movement of the breaking sensor means to the second position thereof for venting air pressure in the third compressed air line means to effect movement of second control valve means to the second air throttling position thereof for effecting movement of the first control valve means to the first air blocking position to allow start-up of normal operation of the spindle and until the first venting means closes by the running thread sensor means returning to its normal operating position to close the first venting means to move the second control valve means to its first position for normal operation of the spindle.

As explained in more detail further on with reference to an exemplified embodiment, the pneumatic control mechanism of the device in accordance with the invention is constructed in a particularly simple manner insofar as it needs only one further control valve. Upon occurrence of a thread breakage, as also in the case of the known device, first of all by way of the first control valve and the switching member the spindle travel is interrupted. Upon actuation of the switching element, for example by the operator, the further control valve is switched into the throttling position. In this way the effectiveness of the monitoring mechanism, thus of the thread sensor, is made ineffective. After performance of the maintenance works and the resetting of the switching element, the second control valve remains in the throttling position, while the spindle starts up again and only when the thread sensor has again reached the operating position is the second control valve again switched back into the open position and thus the monitoring mechanism again switched on.

As is shown further on, in this way a monitorng mechanism is obtained which, on the one hand, causes an immediate switch-off upon thread breakage and, on the other hand, for its re-switching-on needs two procedures taking their course successively, namely on the one hand the resetting of the switching element from the braking position into the rest position and, on the other hand, the transition of the thread sensor out of the switching position into the operating position. Thus, with simple means a reliable switching off and switching on again of the spindle together with a switching-on of the monitoring mechanism which is delayed as compared with the reswitching-on is achievable, without additional operating manipulations having to be carried out by the operator.

For this purpose, the pneumatic control means further includes first input control force means to the first control valve means from the second compressed air line means between the compressed air source means and the second control valve means to position the first control valve means in the first position thereof, and second input control force means to the first control valve means from the first compressed air line means between the compressed air source and the first control valve means to position the first control valve means in the second position thereof. The first input control force means is greater than the second input control force means when the first venting means is closed and the second control valve means is in its first position to open the flow of compressed air in the second compressed air line means. The first input control force means is less than the second input control force means when the first venting means is open and the second control valve means is in its first position. The first input control force means is greater than the second input control force means when the first venting means is open and the second control valve means is in its second position to throttle the flow of compressed air in the second compressed air line means.

There is also preferably provided a third input control force means to the second control valve means from the second compressed air line means between the second control valve means and the first venting means, and fourth input control force means to the second control valve means from the third compressed air line means between the compressed air source means and the second venting means. The third and fourth input control force means act together to position the second control valve means in the first open position thereof. There is further provided fifth input force control means to the second control valve means from the second compressed air line means between the compressed air source means and the second control valve means, and sixth input force control means comprising biasing means to the second control valve means. The fifth and sixth input control force means act together to position the second control valve means in the second throttling position thereof. The third and fourth control force means are greater than the fifth and sixth control force means when the first venting means is closed to position the second control valve means in the first open position thereof. The fourth control force means is greater than the sixth control force means when the second venting means is closed to position the second control valve means in the first open position thereof after opening of the first vent means and until the second vent means is opened. The fifth and sixth control force means are greater than the third and fourth control force means when the first vent means is open and the second vent means is closed to position the second control valve means in the second throttling position thereof until the first vent means closes. Preferably, the third and fourth input control means are identical.

A preferred embodiment of the device of this invention provides for the use of two compressed-air sources which are independent of one another has the advantage that, for example, in an emergency situation an entire machine can be stopped in a very short time, by the lines leading from the second compressed-air source to all of the second control valve of the monitoring mechanism associated with the individual spindles being vented.

All of the control valves can be combined in a valve block which can be arranged at a favourable location inside the machine.

In accordance with a further preferred feature of this invention, the pneumatic cotnrol means includes first throttle means positioned in the second compressed air line means between the compressed air source means and the second control valve means, and second throttle means positioned in the third compressed air line means. The third compressed air line means preferably extends from the second compressed air line means at a position between the compressed air source means and the first throttle means. The open passage cross-section of the first throttle means is greater than the open passage cross-section of the second control valve means when in its throttling position. Preferably, each of the first and second venting means comprise a Pitot tube.

Furthermore it is possible to connect to the output of the second control valve in each case a pneumatic pressure switch, by which signal procedures, in accordance with the position of the thread sensor, can be triggered. An exemplified embodiment of the device in accordance with the invention will be explained in more detail hereinunder with reference to the drawings.

DESCRIPTION OF PREFERRED EMBODIMENT OF THE INVENTION

Figure 1:
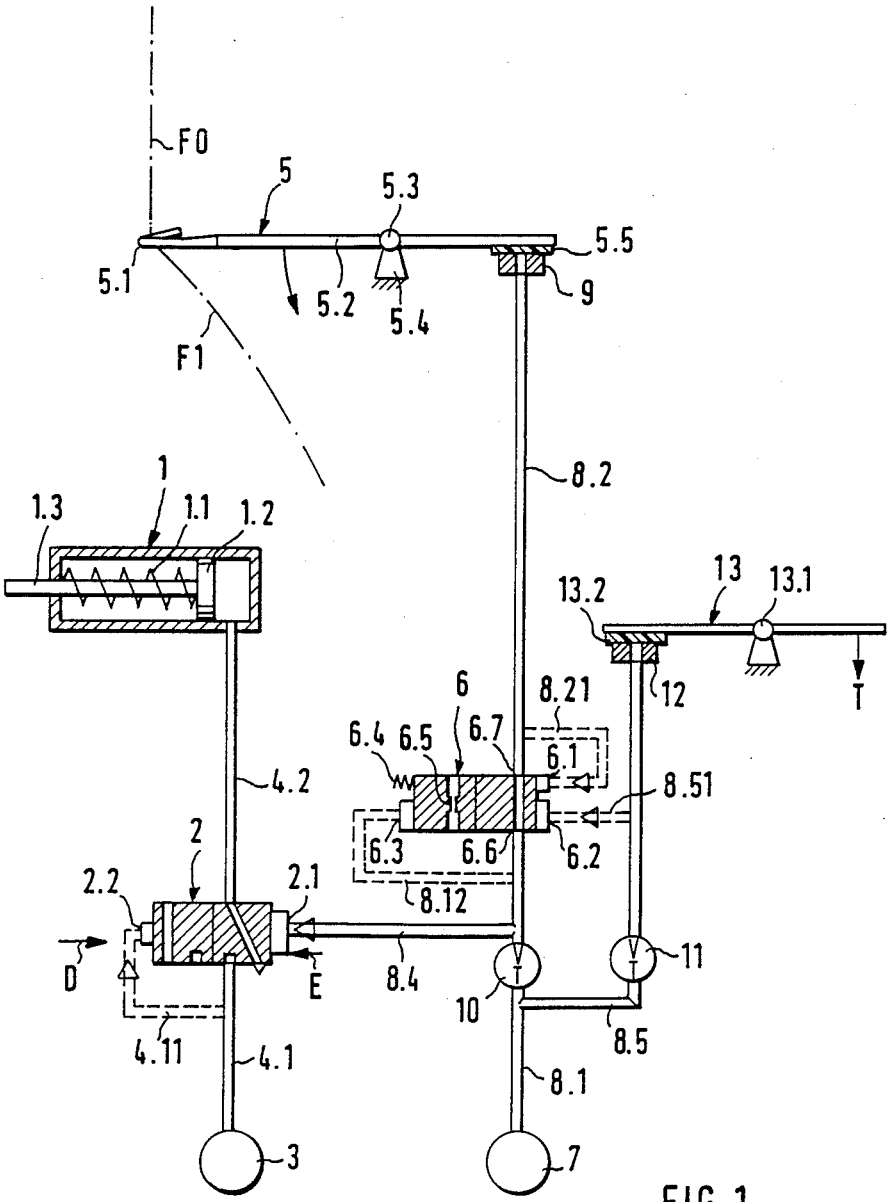
FIG. 1 shows a diagrammatic representation, partially executed as a flow diagram, a device for the switching off and switching on again of a two-for-one twisting spindle having a thread sensor designed in the form of a thread guidance eyelet in the operating position with the twisting thread running.

The device shown in FIGS. 1 to 4 can be arranged on a two-for-one twisting spindle which is otherwise not shown.

It has a pneumatic switching member 1 with a piston 1.2 which can be run out upon being acted upon with compressed air against the force of a compression spring 1.1. The piston rod 1.3 acts, in a manner which is not expressly shown, by way of mechanical or pneumatic means on structural units which can, in the case of a two-for-one twisting spindle, be a spindle stop mechanism, a spindle brake, a spool frame unit, a stoppable friction roller or the like.

The pneumatic switching member 1 is connected by way of a line 4.2 to a control valve 2 and this is connected by way of a line 4.1 to a first compressed-air source 3. The control valve 2 possesses a first control input 2.1, which is connected by way of a line 8.4, a throttle 10 and a further line 8.1 to a second compressed-air source 7. A second control input 2.2 of the control valve 2 is connected by way of a branch line 4.11 to the line 4.1 coming from the first compressed-air source 3. The control surface area of the first control input 2.1 is larger than the control surface area of the second control input 2.2, so that, with the same pressure impingement in the lines 4.1 and 8.4, the force E acting on the first control surface is greater than the force D acting on the second control surface. The control valve 2 is then in the switching position shown in FIG. 1, in which the switching member 1 is not acted upon with compressed air and thus no stoppage procedures of any kind at the spindle are triggered.

The device possesses furthermore a thread sensor 5 with a thread guide eyelet 5.1, through which the thread F0 is passed, in which respect that part F1 of the thread which is arranged in the drawing underneath the thread guide eyelet 5.1 belongs to the thread balloon of the two-for-one twisting spindle. The thread guide eyelet 5.1 is fastened to the front end of a supporting rod 5.2, which is swivelable in the vertical direction about a swivel axis 5.3. The swivel axis 5.3 is mounted in a holder 5.4, which forms a part of the machine frame which is not otherwise shown. The thread sensor 5 assumes, with the thread running. i.e. in the presence of an adequate thread tension, in each case the horizontal position shown in FIG. 1, in which it seals, with a seal 5.5 arranged at its rear end, a Pitot tube 9.

The Pitot tube 9 is connected by way of a line 8.2, a further control valve 6 and the line 8.1 which contains the throttle 10, to the second compressed-air source 7.

The control valve 6 possesses three control inputs 6.1, 6.2 and 6.3. In the passage position shown in FIG. 1, connected in between the Pitot tube 9 and the second compressed-air source 7 is merely the throttle 10.

The first control input 6.1 of the control valve 6 is connected by way of a branch line 8.21 to the output 6.7 of the control valve.

the second control input 6.2 is connected by way of a branch line 8.51 to a line 8.5, which leads from the second compressed-air source 7 by way of a throttle 11 to a further Pitot tube 12, which is associated with a switching element 13 which will be designated hereinafter as "braking sensor". The braking sensor 13 is swingable about a vertical axis 13.1 and carries at its rear end a seal 13.2, by way of which it seals, in the rest position shown in FIG. 1, the Pitot tube 12.

Furthermore, the braking sensor 13 is connected, in a manner which is not shown, to braking members which, as soon as it is forced in the direction of the arrow T into the braking position, decelerate and restrain the spindle.

The third control input 6.3 of the control valve 6 is connected by way of a branch line 8.12 to the working input 6.6 and thus the line 8.1.

The position of the control valve 6 is influenced, apart from by the control surfaces associated with the three control inputs, by a compression spring 6.4, namely in the direction of a throttling position of the control valve in which connected into the compressed-air path between the lines 8.1 and 8.2 is a further throttle 6.5, the passage cross-section of which is smaller than the passage cross-section of the throttle 10.

The control valve 6 is distinguished in that the surface ratios of the control surfaces associated with the control inputs 6.1, 6.2 and 6.3 are so designed that, with joint acting-upon of the control inputs 6.1 and 6.2, the sum of the forces B+C effective at these control surfaces is greater than when the control input 6.3 is acted upon, the sum A+F of the force A effective at this control surface and the force F of the compression spring 6.4. Furthermore, the surface dimensioning is such that, when only the second control input 6.2 is acted upon, the force B effective at the corresponding control surface is greater than the force of the compressin spring 6.4, but smaller than the sum A+F of the effective force A when the control input 6.3 is acted upon and the force F of the compression spring 6.4.

In practice this can so appear that the control surfaces associated with the control inputs 6.2 and 6.3 have the same size and the control surface associated with the control input 6.1 is so dimensioned that the force effective here upon pressure impingement is greater than the force of the compression spring 6.4.

By virtue of this dimensioning, the monitoring mechanism formed by the thread sensor 5, the control valve 6, the second compressed-air source 7 and the braking sensor 13 shows a behaviour which will be explained in more detail hereinunder with reference to FIGS. 1 to 4.

In FIG. 1 the device is shown in the normal operating state, i.e. with the twisting thread running. The Pitot tube 9 is sealed by the thread sensor 5 and the Pitot tube 12 is sealed by the braking sensor 13. The control valve 6 is in the passage position and is restrained in this open position by the pressure building up in the lines 8.1, 8.2 and 8.5, by reason of the above-indicated condition for the force ratios.

As a result of the pressure building up in the line 8.4, the control valve 2 remains in the position in which the switching member 1 is not acted upon with the pressure.

Figure 2:
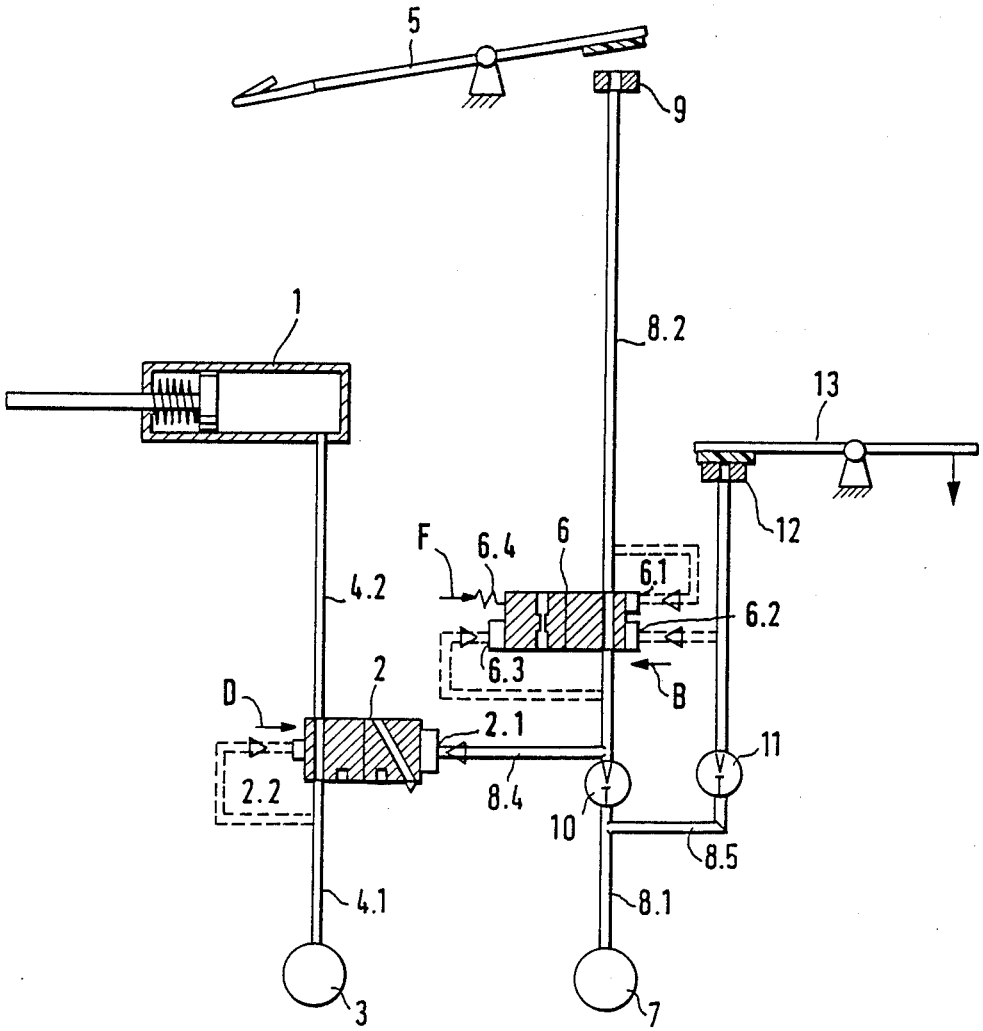
FIG. 2 shows the device in accordance with FIG. 1 in the operating position immediately after the occurrence of a thread breakage.

The position upon the occurrence of a thread breakage is shown in FIG. 2. The thread sensor 5 frees the Pitot tube 9. This has the result that the pressure in the line 8.2 behind the throttle 10 collapses, which causes the control valve 2, by reason of the pressure acting by way of the lines 4.1 and 4.11, to switch into the passage position shown in FIG. 2, in which the switching member 1 is acted upon the compressed air and triggers the corresponding switch-off procedures and signal procedures and signal procedures. The control valve 6 remains initially in the open passage position, since, as a result of the throttles 10 and 11 and the sealing of the Pitot tube 12, the pressure in the lines 8.5 and 8.51 is maintained and thus the following force conditions arise:

$$B>F,\ A=0,\ C=0,\ E=0,\ D>E.$$

Figure 3:
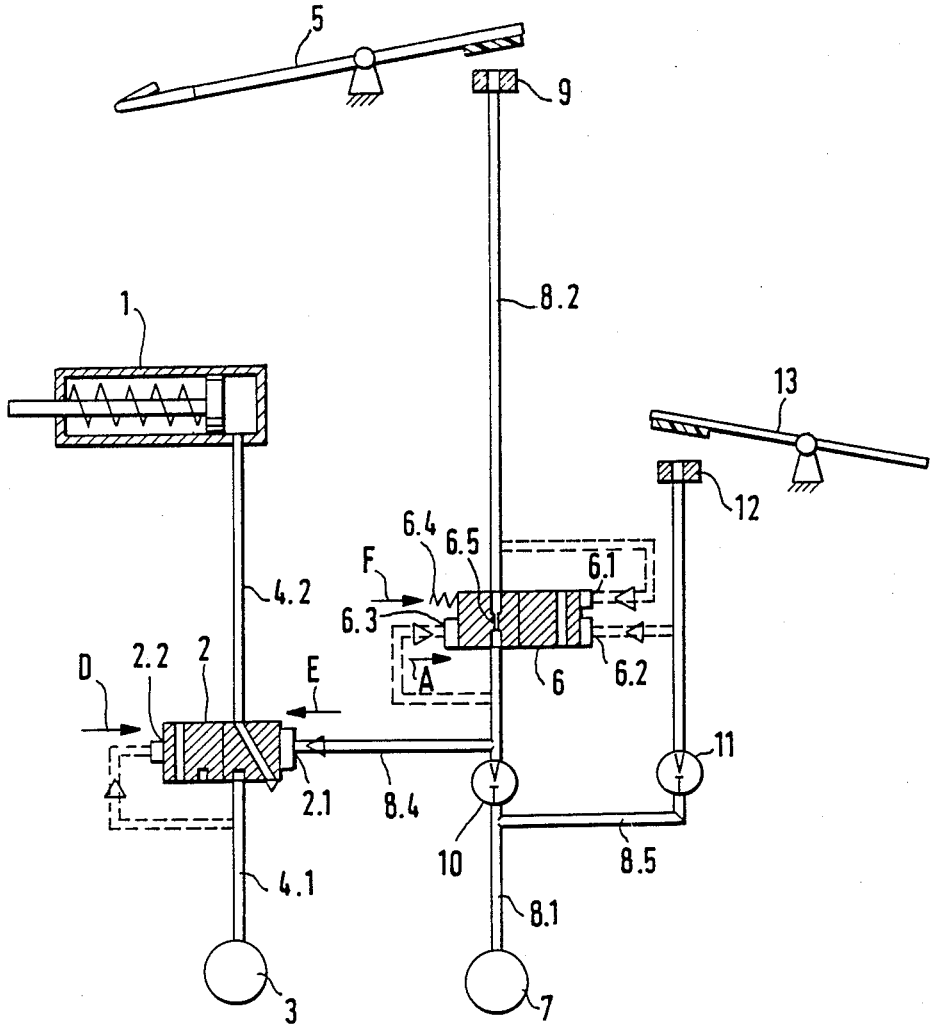
FIG. 3 shows the device in accordance with FIG. 1 in the operating position during the performance of the maintenance works.

Shown in FIG. 3 is the situation after actuation of the braking sensor 13 in the direction T for example by an operator. The Pitot tube 12 is now opened and this has the result that the control valve 6 switches into the throttling position, namely initially under the influence of the force F of the compression spring 6.4, since $B=C=0$. After the switch-over, on account of the cross-sectional ratios of the throttles 6.5 and 10 there builds up in the lines 8.4 and 8.12 again a certain pressure, which contributes to the fact that the control valve 6 is restrained in the throttling position and the control valve 2 is returned again into the initial position, in which the switching member 1 is no longer acted upon with pressure and thus a re-start of the spindle is possible.

Figure 4:
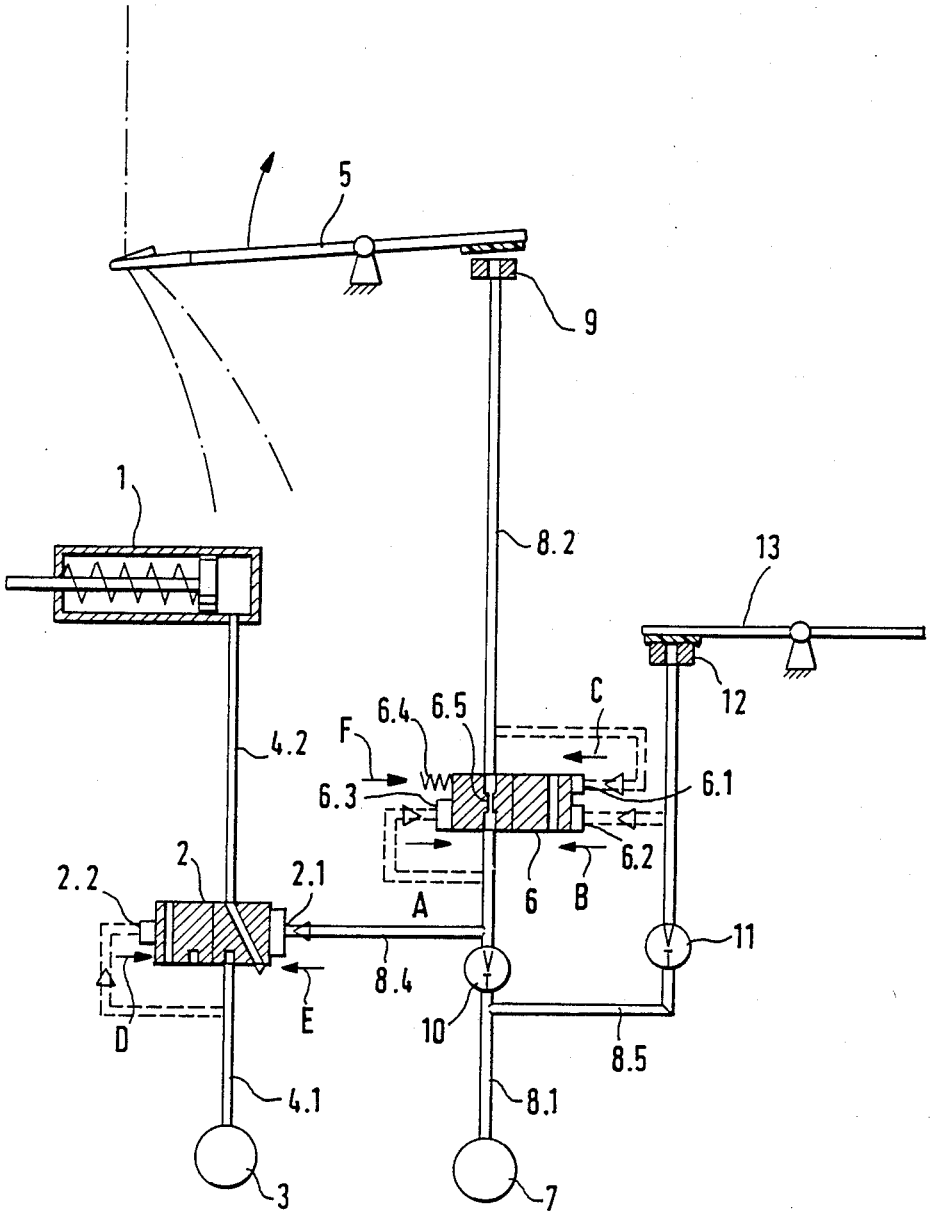
FIG. 4 shows the device in accordance with FIG. 1 in the operating position during the re-start of the spindle.

If now, after performance of the servicing work and the rethreading of the thread FO, the braking sensor 13 is set back into the rest position and the Pitot tube 12 is sealed again, the spindle can indeed start up, but the control valve 6 remains in its throttling position shown in FIG. 4. This can be attributed to the fact that for the effective forces initially there applies $A=B$, $C=0$ and $F>0$. This means, although the spindle starts up again, that the monitoring mechanism is still switched off and, since the thread sensor is not yet under the full thread tension, a switch-off and alarm procedure cannot be triggered immediately again. Only when the full thread tension has occurred at the thread sensor 5 again, the Pitot tube 9 is sealed and the force C has again assumed its nominal value does the control valve 6, on account of the condition $C+A>A+F$, again switch over into the open position, as is shown in FIG. 1.

The switching-on again of the monitoring mechanism thus takes place in the sense of an AND-condition which requires that the two control inputs 6.1 and 6.2 both have to be acted upon with pressure, so that the monitoring function can start again. On the other hand, however, the monitoring mechanism does not need to be switched on expressly by the operator. On the contrary it is sufficient if this latter, in the manner to which he is accustomed, after the servicing work returns the braking sensor 13 into the rest position and thus automatically triggers the re-start of the spindle and the delayed switching-on of the monitoring mechanism.

As is readily evident, for example a temporary sealing of the Pitot tube 9 during the servicing work (see FIG. 3) has no effects of any kind on the monitoring mechanism as well as the switching member 1.

Furthermore, the device shown has the advantage that, with the twisting thread running (see FIG. 1), if there is a temporary opening of the Pitot tube 12 by actuation of the braking sensor 13, the control valve 2 is not switched over and thus the switching member 1 is not actuated. On the contrary by switch-over of the control valve 6 the thread sensor 5 is uncoupled from the monitoring mechanism, so that no switch-off procedure occurs even when, through abatement of the thread tension, the Pitot tube 9 is opened. This is important, since such an undesired switch-off procedure can lead to a thread breakage.

Furthermore, the device offers the possibility of a central switch-off of all the spindles of a machine, by the second compressed-air source 7 being switched off during the state shown in FIG. 1. At this instant all the control valves 2 are switched over and the corresponding switching members 1 respond and trigger the switch-off procedures and signal procedures.

In this way the possibility is afforded, in an emergency situation, of stopping a two-for-one twisting machine in a very short time.

Connected to the line 8.2 there can be, in a manner not expressly shown, further pneumatic pressure switches which trigger control or signal procedures if the Pitot tube 9 is opened.

Of course, the thread sensor 5 does not necessarily need to be connected to the thread guide eyelet. It can hereto be a matter of a different member which is dependent in its position upon the thread tension.

I claim:

1. A device for switching off and switching on the operation of a spindle of a textile twisting or spinning machine having a running thread, said device comprising:

pneumatic switching means adapted to be operatively connected to a spindle stop mechanism of the textile machine for actuation and de-actuation thereof;

movable running thread sensor means for being held in a first normal operating position by the running thread in the textile machine and for moving to a second switching position upon breakage of the running thread;

movable braking sensor means adapted to be operatively connected to a spindle braking mechanism of the textile machine for moving between a first position during normal operation of the spindle to a second position upon actuation of the spindle braking mechanism after thread breakage; and pneumatic control means operatively connected to said pneumatic switching means, said running thread sensor means and said movable braking sensor means for operating said switching means to actuate the spindle stop mechanism upon breaking of the running thread to stop the spindle operation and for de-actuating the spindle stop mechanism upon actuation of the spindle braking mechanism and before said running thread sensor means has returned to its normal operating position by the running thread during subsequent start up of the spindle operation, said pneumatic control means comprising compressed air source means, first compressed air line means connecting said compressed air source means to said pneumatic switching means, first control valve means positioned in said first compressed air line means for blocking the flow of compressed air to said switching means from said source in a first position thereof to deactuate the spindle stop mechanism during normal operating conditions of the spindle and for opening the flow of compressed air to said switching means from said source in a second position thereof to operate said switching means to actuate said spindle stop mechanism upon breakage of the running thread, second compressed air line means extending between said thread sensor means, said compressed air source means and said first control valve means for maintaining said first control valve means in its first air blocking position under normal air pressure therein, second control valve means positioned in said second compressed air line means for opening the flow of compressed air in said second compressed air line means in a first position thereof during normal operation of the spindle and for throttling the flow of compressed air in said second compressed air line means in a second position thereof, first venting means in said second compressed air line means for being closed when said running thread sensor means is held in the first normal operating position thereof and for being opened upon thread breakage and said thread sensor means moving to its second switching position for venting air pressure in said second compressed air line means to effect movement of said first control valve means to open the flow of compressed air to said pneumatic switching means to operate the spindle stop mechanism, third compressed air line means extending between said second compressed air line means, said movable braking sensor means and said second control valve means, and second venting means in said third compressed air line means for being closed when said braking sensor means is in the first position thereof and for being opened upon actuation of the spindle braking mechanism and movement of said braking sensor means to the second position thereof for venting air pressure in said third compressed air line means to effect movement of said second control valve means to the second air throttling position thereof for effecting movement of said first control valve means to the first air blocking position to allow start up of normal operation of the spindle and until said first venting means closes by said running thread sensor means returning to its normal operating position to close said first venting means to move said second control valve means to its first position for normal operation of the spindle.

2. A device, as set forth in claim 1, in which said pneumatic control means further includes first input control force means to said first control value means from said second compressed air line means between said compressed air source means and said second control valve means to position said first control valve means in the first position thereof, and second input control force means to said first control valve means from said first compressed air line means between said compressed air source means and said first control valve means to position said first control valve means in the second position thereof; and wherein said first input control force means is greater than said second input control force means when said first venting means is closed and said second control valve means is in its first position to open the flow of compressed air in said second compressed air line means, said first input control force means is less than said second input control force means when said first venting means is open and said second control valve means is in its first position, and said first input control force means is greater than said second input control force means when said first venting means is open and said second control valve means is in its second position to throttle the flow of compressed air in said second compressed air line means.

3. A device, as set forth in claim 2, in which said pneumatic control means further includes third input control force means to said second control valve means from said second compressed air line means between said second control valve means and said first venting means, fourth input control force means to said second control valve means from said third compressed air line means between said compressed air source means and said second venting means, said third and fourth input control force means acting together to position said second control valve means in the first open position thereof, fifth input force control means to said second control valve from said second compressed air line means between said compressed air source means and said second control valve means, sixth input force control means comprising biasing means to said second control valve means, said fifth and sixth input control force means acting together to position said second control valve means in the second throttling position thereof; and wherein said third and fourth control force means are greater than said fifth and sixth control force means when said first venting means is closed to position said second control valve means in the first open position thereof, said fourth control force means is greater than said sixth control force means when said second venting means is closed to position said second control valve means in the first open position after opening of said first vent means and until said second vent means is opened, and said fifth and sixth control force means being greater than said third and fourth control force means when said first vent means is open and said second vent means is closed to position said second control valve means in the second throttling position thereof until said first vent means closes.

4. A device, as set forth in claim 3, in which said third and fourth input control force means are identical.

5. A device, as set forth in claim 3, in which said pneumatic control means further includes first throttle means positioned in said second compressed air line means between said compressed air source means and said second control valve means, second throttle means positioned in said third compressed air line means; and wherein said third compressed air line means extends from said second compressed air line means at a position between said compressed air source means and said first throttle means, and the open passage cross-section of said first throttle means is greater than the open passage cross-section of said second control valve means when in its second throttling position.

6. A device, as set forth in claim 1, 2, 3, 4 or 5, in which each of said first and second venting means comprise a Pitot tube.

7. A device, as set forth in claim 1, 2, 3, 4 or 5, in which said compressed air source means comprises a first compressed air source means connected to said first compressed air line means, and a second compressed air source means connected to said second compressed air line means.

8. A device, as set forth in claim 1, 2, 3, 4 or 5, in which each of said first and second venting means comprises a Pitot tube; and in which said compressed air source means comprises a first compressed air source means connected to said first compressed air line means, and a second compressed air source means connected to said second compressed air line means.

* * * * *

UNITED STATES PATENT AND TRADEMARK OFFICE

CERTIFICATE OF CORRECTION

PATENT NO. : 4,845,933

DATED : July 11, 1989

INVENTOR(S) : Siegfried Inger

It is certified that error appears in the above-identified patent and that said Letters Patent is hereby corrected as shown below:

Cover page, add "A" at the beginning of title and delete "More Especially A Two-For-One Spinning Or Twisting Spindle"

Cover page, line 22 of the Abstract, delete "the" (second occurrence) and add -- for --.

Column 3, line 45, "monitorng" should be -- monitoring --.

Column 4, line 63, "cotnrol" should be -- control --.

Column 7, line 26, delete "and signal procedures".

Column 7, line 65, after "open" insert -- passage --.

Signed and Sealed this

Twenty-fourth Day of April, 1990

*Attest:*

HARRY F. MANBECK, JR.

*Attesting Officer*

*Commissioner of Patents and Trademarks*